US009452909B2

(12) United States Patent
Taylor et al.

(10) Patent No.: US 9,452,909 B2
(45) Date of Patent: Sep. 27, 2016

(54) SAFETY RELATED ELEVATOR SERIAL COMMUNICATION TECHNOLOGY

(71) Applicant: ThyssenKrupp Elevator AG, Essen (DE)

(72) Inventors: Christopher Taylor, Olive Branch, MS (US); Charlie Thurmond, Olive Branch, MS (US); Fabio Speggiorin, Collierville, TN (US)

(73) Assignee: ThyssenKrupp Elevator AG, Essen (DE)

( * ) Notice: Subject to any disclaimer, the term of this patent is extended or adjusted under 35 U.S.C. 154(b) by 310 days.

(21) Appl. No.: 14/219,494

(22) Filed: Mar. 19, 2014

(65) Prior Publication Data

US 2015/0114764 A1 Apr. 30, 2015

Related U.S. Application Data

(60) Provisional application No. 61/895,477, filed on Oct. 25, 2013.

(51) Int. Cl.

| | |
|---|---|
| ***B66B 1/28*** | (2006.01) |
| ***B66B 1/34*** | (2006.01) |
| ***B66B 5/00*** | (2006.01) |

(52) U.S. Cl.

CPC ..... *B66B 1/3453* (2013.01); *B66B 1/34* (2013.01); *B66B 1/3446* (2013.01); *B66B 5/0031* (2013.01); *B66B 5/0087* (2013.01)

(58) Field of Classification Search

CPC ..... B66B 1/34; B66B 1/3453; B66B 1/3446; B66B 5/0031; B66B 5/0087

USPC ..... 187/247, 380–88, 391, 393; 340/12.15; 370/366

See application file for complete search history.

(56) References Cited

U.S. PATENT DOCUMENTS

| | | | | |
|---|---|---|---|---|
| 3,807,531 | A * | 4/1974 | Mandel | B66B 1/468 187/380 |
| 3,841,443 | A * | 10/1974 | Booker, Jr. | B66B 1/16 187/380 |
| 4,397,377 | A * | 8/1983 | Husson | B66B 5/0006 187/382 |
| 4,473,133 | A * | 9/1984 | Enriquez | B66B 1/18 187/247 |
| 4,497,391 | A | 2/1985 | Mendelsohn et al. | |
| 4,778,035 | A * | 10/1988 | Tanino | B66B 3/02 187/399 |

(Continued)

FOREIGN PATENT DOCUMENTS

| | | |
|---|---|---|
| EP | 2 117 144 | 11/2009 |
| JP | H06 227766 | 8/1994 |

OTHER PUBLICATIONS

Hima, et at., "Introduction in safety bus systems," 2002, accessed from www.iceweb.com.au/sis/Hima%20-% 20Safety%20Bus%20 Systems%2002.pdf.

(Continued)

*Primary Examiner* — Anthony Salata
(74) *Attorney, Agent, or Firm* — Frost Brown Todd LLC

(57) ABSTRACT

Safety related information for an elevator installation can be transmitted via a serial connection using serialization and deserialization modules. These serialization and deserialization modules can comprise redundant components, such as processors and interfaces, and can be configured to cross check various data inputs and outputs to identify data corruption, component failures, or inconsistencies in data.

16 Claims, 3 Drawing Sheets

(56) References Cited

U.S. PATENT DOCUMENTS

| | | | | |
|---|---|---|---|---|
| 4,823,914 | A * | 4/1989 | McKinney | B66B 5/0037 187/393 |
| 5,137,118 | A * | 8/1992 | Iwata | B66B 13/146 187/247 |
| 5,352,857 | A * | 10/1994 | Ovaska | B66B 1/18 187/247 |
| 5,551,532 | A | 9/1996 | Kupersmith | |
| 5,616,894 | A | 4/1997 | Nieminen et al. | |
| 6,003,637 | A | 12/1999 | Kim et al. | |
| 6,173,814 | B1 | 1/2001 | Herkel et al. | |
| 6,378,662 | B1 | 4/2002 | Yamada | |
| 6,672,429 | B1 | 1/2004 | Thurmond, III | |
| 7,073,633 | B2 | 7/2006 | Weinberger et al. | |
| 7,314,120 | B2 | 1/2008 | Jahkonen | |
| 7,535,957 | B2 | 5/2009 | Ozawa et al. | |
| 7,669,698 | B2 | 3/2010 | Jahkonen | |
| 7,849,975 | B2 | 12/2010 | Ketonen et al. | |
| 7,900,750 | B2 * | 3/2011 | Mattsson | B66B 1/2458 187/247 |
| 7,918,318 | B2 | 4/2011 | Friedli et al. | |
| 7,946,393 | B2 | 5/2011 | Thumm | |
| 8,096,387 | B2 | 1/2012 | Kattainen et al. | |
| 8,134,448 | B2 * | 3/2012 | Oster | H04L 12/423 187/391 |
| 8,151,943 | B2 | 4/2012 | de Groot | |
| 8,230,977 | B2 | 7/2012 | Thumm et al. | |
| 8,235,180 | B2 | 8/2012 | Kattainen et al. | |
| 8,261,885 | B2 | 9/2012 | Ketoviita et al. | |
| 8,875,156 | B2 * | 10/2014 | Kowal | G05B 19/0426 719/313 |
| 2011/0120814 | A1 | 5/2011 | Schuster | |
| 2011/0247901 | A1 | 10/2011 | Wilke et al. | |
| 2012/0312639 | A1 | 12/2012 | Arnold et al. | |
| 2013/0192932 | A1 * | 8/2013 | Parillo | B66B 5/0018 187/289 |
| 2014/0032970 | A1 * | 1/2014 | Hovi | G06F 11/26 714/37 |

OTHER PUBLICATIONS

Rahmani, et al., "Error Detection Capabilities of Automotive Network Technologies And Ethernet—A Comparative Study," Intelligent Vehicles Symposium, 2007 IEEE, Jun. 13-15, 2007, pp. 674-679.

Ray, et al., "Efficient High Hamming Distance CRCs for Embedded Networks," Dependable Systems and Networks (DSN), Jun. 25-28, 2006, Philadelphia, PA.

Safety Code for Elevators and Escalators, The American Society of Mechanical Engineers, 2013, pp. 114-121.

International Search Report and Written Opinion dated Feb. 16, 2015 for Application No. PCT/IB2014/002553.

* cited by examiner

SAFETY RELATED ELEVATOR SERIAL COMMUNICATION TECHNOLOGY

CROSS REFERENCE TO RELATED APPLICATIONS

This application is a non-provisional of, and claims the benefit of, U.S. provisional patent application 61/895,477, filed Oct. 25, 2013, having the same title and inventors as the present application. The disclosure of that provisional patent application is hereby incorporated by reference in its entirety.

FIELD

The disclosed technology pertains to transmitting safety related information in an elevator installation.

BACKGROUND

The capacity to operate safely is critical for any elevator installation. As a result, modern elevator installations are designed to allow for the capture of a substantial amount of information related to the cars they contain, and for the use of that information to ensure that the elevator cars operate in a safe manner. While this capture and use of safety related information is beneficial in maintaining the safety of elevator cars, it has drawbacks as well. For example, when safety related information is captured and processed at different components, that information has historically been communicated from the capturing component(s) to the processing component(s) with discrete wires for each piece of captured information. This generally results in the use of 10-15 discrete wires for the communication of safety related information, which increases the cost of the elevator installation, both in terms of the material cost of the wires, and the labor cost for installing them.

SUMMARY

The technology disclosed herein can be used to implement a safety information communication system comprising an input device and an output device. In such a communication system, the input device can comprise a communication module and a first plurality of microcontrollers, while the output device can comprise a plurality of serial peripheral interfaces and a second plurality of microcontrollers. Where they are present, a first plurality of microcontrollers from an input device can be comprised of microcontrollers which are each configured to periodically receive a plurality of items of safety related data for an elevator car, build a first data package, and send the first data package to the communication module. The communication module, in turn, can be configured to transmit the first data package to the output device in a serial format. A second plurality of microcontrollers in an output device can also comprise microcontrollers which are each configured to perform a set of tasks. For example, a set of tasks that the microcontrollers from the second plurality of microcontrollers could be configured to perform could comprise receiving the first data package, checking for errors in the first data package, building a second data package, and sending the second data package to an elevator controller via the plurality of serial peripheral interfaces.

In a system such as described above, the input device can be configured to cross check the safety related data among the microcontrollers from the first plurality of microcontrollers comprised by the input device. Additionally, in such a system, a first data package built by the microcontrollers comprised by the input device could comprise the plurality of items of safety related data for the elevator car and a code for errors detected by the input device. The second data package built by the microcontrollers comprised by the output device could comprise the plurality of items of safety data for the elevator car, the code for errors detected by the first input device, and a code for errors detected by the output device.

It should be understood that other approaches to implementing the inventors' technology, including in novel machines, methods, or articles of manufacture, or in systems which may not correspond to the example system described above, are also possible, and will be immediately apparent to those of ordinary skill in the art in light of the disclosure set forth herein. Accordingly, this summary should be understood as being exemplary only of how the inventors' technology could be implemented, and should not be treated as limiting on the protection accorded by this document, or by any related document.

BRIEF DESCRIPTION OF THE DRAWINGS

The drawings and detailed description which follow are intended to be merely illustrative and are not intended to limit the scope of the invention as contemplated by the inventors.

DETAILED DESCRIPTION

The inventors have conceived of novel technology which, for the purpose of illustration, is disclosed herein as applied in the context of communicating safety related information in an elevator installation using a serial connection. While the disclosed applications of the inventors' technology satisfy a long felt but unmet need in the art of communicating safety related information in an elevator installation, it should be understood that the inventors' technology is not limited to being implemented in the precise manners set forth herein, and that other implementations will be immediately apparent to, and could be implemented without undue experimentation by, those of ordinary skill in the art in light of this disclosure. Accordingly, the examples set forth herein should be understood as being illustrative only, and should not be treated as limiting.

Figure 1:
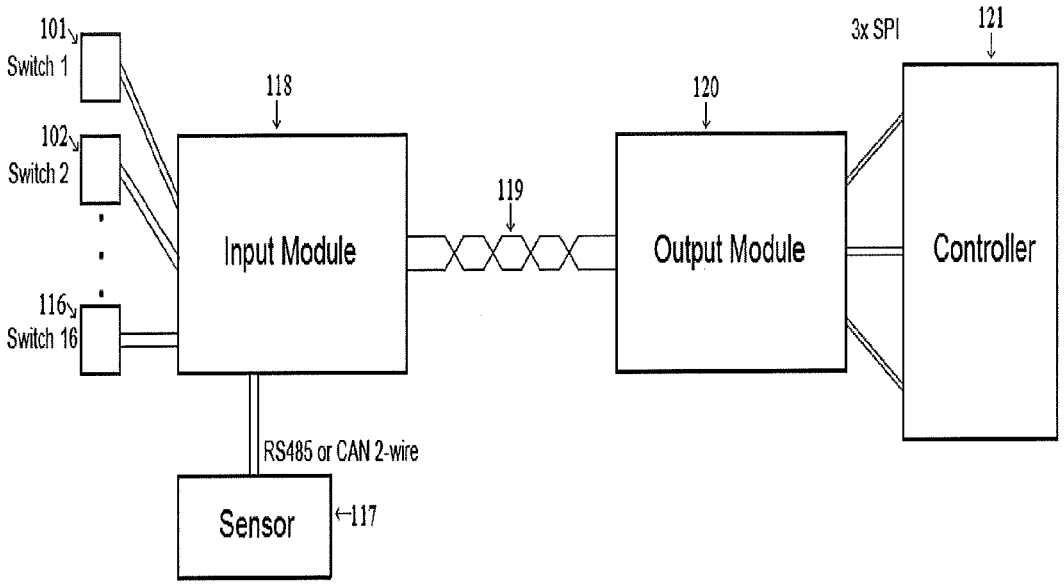
FIG. 1 depicts a high level overview of a system which could be used to capture elevator safety related information and transmit it over a serial connection.

Turning now to the figures, FIG. 1 depicts a high level overview of a system which could be used to capture elevator safety related information and transmit it over a serial connection. In the system of FIG. 1, safety related information is captured from switches [101][102][116] representing elevator doors, stop switches, inspection switches and various other safety based switches. For example, a typical set of switches could be Car Door Contact Front (CDCF), Car Door Contact Rear (CDCR), Final Limit (FTSD), Safety Gear Switch (SAFGR), In-car stop switch (CST), Cartop inspection transfer switch (INCTM), Cartop inspection up (INCTU), Cartop inspection down (INCTD), Cartop Inspection Enable (INCTE), Hoistway Enable switch (INHAM), and 7 other switches wired in series to 1 input (SAFCAR) including Emergency Exit switch, Comp Chain Pull-out switch, Pendant Station Stop switch, Car Movement Lock, Cartop stop switch, Rear Cartop stop switch, and fireman stop switch. Other switches or combinations of switches are also possible, and the particular switches used can vary from installation to installation (e.g., based on local safety codes). Similarly, in some cases, the inventors' technology might be configured to read information from a larger number of switches than are actually present, in which case the absent switch(es) could be replaced by wire jumper(s).

A system such as shown in FIG. 1 can also capture safety related information from other types of devices, such as one or more sensors [117] used to detect the position, velocity and/or speed of an elevator car. This capture can be achieved through use of a serialization module [118], which could be configured to read the safety related information from the switches [101][102][116] and/or various sensors [117], and to send it in serial form over a traveling cable [119] to a deserialization module [120]. The deserialization module [120] could be configured to, once it had received the safety related information, deserialize the information and communicate it to an elevator controller [121]. Of course, it is possible that other types of safety related information could be captured and sent to the deserialization module [120] as well. For example, in some embodiments following the diagram of FIG. 1, external sensors [117] such as shown in that figure could be absolute position sensors which could be configured to detect faults as part of their position and velocity calculations. In such embodiments, any faults detected by an external sensor [117] could be sent to the serialization module [118] from which they could be communicated to, and handled by, a controller [121] via the deseriailzation module [120] in a manner similar to that described herein for other types of errors.

Preferably, the serialization module [118] will be configured to send the safety related information via transmissions taking place every 5 ms over a single twisted pair cable up to 1500 meters long using a non-return to zero code. However, it should be understood that variations on that preferred approach, such as the use of other transmission frequencies, other types of physical media for the traveling cable [119] (e.g., redundant transmission wires), or other types of encoding schemes (e.g., Hamming codes, return to zero codes, etc) known to those of ordinary skill in the art could also be used to implement a system shown in FIG. 1.

Preferably, in a system such as shown in FIG. 1, the serialization module [118] and deserialization module [120] will both be implemented as two separate PCB plug in boards. Such PCB plug in boards may be encased in housings, though it should be understood that, where the serialization module [118] and/or the deserialization module [120] is implemented as a PCB plug in board, it is not necessary for such a board to be encased in a housing for it to be used in a system such as shown in FIG. 1.

Figure 2:
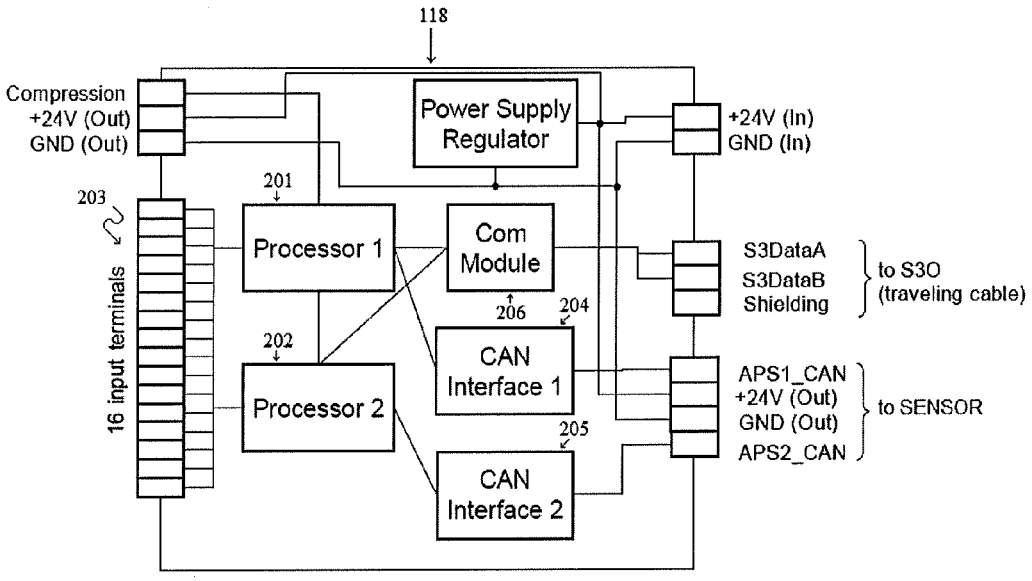
FIG. 2 illustrates an exemplary set of components which could be used to implement a serialization module such as shown in FIG. 1.

Turning now to FIG. 2, that figure illustrates an exemplary set of components which could be used to implement a serialization module [118] such as shown in FIG. 1. To illustrate how those components could interact with each other and operate in a serialization module [118], the components of FIG. 2 are described in the context of performing four main functions: reading safety related switches [101][102][116], reading information from an external sensor [117], building a data package for transmission to the deserialization module [120], and transmitting the safety related information to the deserialization module [120]. It should be understood that, while the material included in this description represents a preferred approach to implementing a serialization module [118], other approaches to implementing a serialization module [118], such as approaches in which the module reads different information, reads the information from different devices or numbers of devices, or uses different components and/or levels of redundancy are also possible, and will be immediately apparent to those of ordinary skill in the art in light of this disclosure. Accordingly, FIG. 2, and the disclosure corresponding to that figure, should be understood as being illustrative only, and should not be treated as limiting.

Turning now to how the components depicted in FIG. 2 could be used to perform the functions described above, the functions of reading the safety related switches [101][102][116] and reading the information from the external sensor [117] can be performed using two microcontrollers [201][202] and two network interfaces (depicted as CAN interfaces [204][205]). These microcontrollers [201][202] would preferably be configured (e.g., through appropriately programmed software or firmware) to compare the read signals on the switch input terminals [203] (shown as 16 input terminals in FIG. 2, though different numbers (e.g., more terminals in a serialization module [118] which intended to capture input from more than 16 switches) could also be used). Similarly, the microcontrollers [201][202] would also preferably each be configured to receive and cross check information from multiple external sensors [117] via the corresponding CAN interfaces [204][205]. These comparisons and cross checks could be used to detect data corruption, short circuits or stuck-at-failures, thereby increasing the overall safety of the system.

This same approach to increasing safety through redundant processing can also be used in building a data package with the safety related information for transmission to the deserialization module [120]. In particular, in a preferred embodiment, each microcontroller [201] [202] will independently build the data package. This allows the integrity of the microcontrollers [201][202] to be checked through comparison of the independently built data packages. For example, it is possible that one of the microcontrollers [201] could operate as a master microcontroller [which would transmit a data package to the communication module [206], while the other microcontroller [202] could operate as a slave microcontroller which would not transmit a data package, but would instead monitor the communication module [206] for data packages transmitted by the master microcontroller [201]. In such an implementation, when a slave microcontroller detects a transmission from the master microcontroller it will compare the data package in that communication with its own independently build data package and disable the inbound transmission to the communication module if the packages are inconsistent. Of course, other approaches to ensuring the consistency of the data packets, such as using a separate comparison component of the serialization module [118] (not shown in FIG. 1), or through use of microcontrollers in the deserialization module [120] are also possible, and will be immediately apparent to, and could be implemented without undue experimentation by, those of ordinary skill in the art in light of this disclosure.

Not only does the disclosed technology improve safety by allowing data packages to be independently built and checked for consistency, the information in a data package can also support increased reliability, and therefore safety, for the system. For example, the microcontrollers [201][202] and/or a separate communications module [206] can be configured to create the data package to include, in addition to safety related information captured from sensors or switches, failure codes or status information determined by the serialization module [118] itself. For example, in some embodiments, microprocessors [201][202] in a serialization module could be configured to detect and generate error codes for internal errors, such as failures of components or failures to communicate with external sensors [107]. Similarly, such microprocessors [201][202] could be configured to detect errors in the operation of an external sensor [107], such as by checking, for example, the sequence number, time expectation, or CRC from a frame used in communicating data from an external sensor [107], to verify that that data is valid. Similarly, in implementations using a dual channel absolute position sensors as an external sensor [107], a microprocessor [201][202] from a serialization module could be configured to cross check information from those channels (e.g., by comparing the positions of the two channels and, if they do not match an expected fixed position offset, logging a communication error). Various types of administrative data could also be added to a data package, such as a sequence counter and a cyclic redundancy check/checksum value over the whole data carrier which could potentially be used by the deserialization module [120] to find corrupted data.

Figure 3:
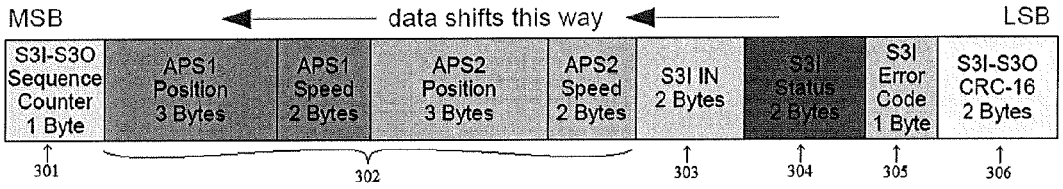
FIG. 3 illustrates and exemplary format which could be used for the transmission of data between serialization and deserialization modules in a system such as shown in FIG. 1.

An exemplary format which could be used for a data package to be transmitted between the serialization module [118] (referred to as S3I) and the deserialization module [120] (referred to as S3O) is illustrated in FIG. 3. In a data package following the format of FIG. 3, the first byte of the package [301] will include the sequence counter added by the microcontrollers [201][202]. The next ten bytes of the package [302] will include position and speed information retrieved from external sensors (referred to in FIG. 3 as data from the APS, an acronym for Absolute Position Sensor). The following two bytes of the package [303] include information on the status of the safety related switches, with the values of the individual bits (e.g., zero or one) indicating the status of the individual switches. The two bytes after that [304] include information on the status of the serialization module [118]. This status information can include information such as the manufacturer of the external sensors, whether the external sensors are properly aligned or need alignment for some reason (e.g., reading too close, reading too far, reading too left, reading too right), and whether the elevator car associated with the serialization module is ok, is recommended for service, is operating in a warning state (e.g., that it should go to its target floor then cease operation), and whether it is (or should be) stopped. The next one byte field in the package [305] would include codes providing information on errors. These error codes could indicate error types such as that there is an error in the position or velocity found by an external sensor, that an internal error was detected in the serialization module, that there is a fault in a switch, that there are alignment errors, communication faults or internal errors in a sensor, or other types of error information. Finally, the last two bytes [306] of a package sent using the format of FIG. 3 will include a cyclic redundancy check value which, as described previously, can be used to identify corrupted data in the package.

Preferably, when a package containing error codes indicating that an error has been detected is received, the elevator associated with the serialization module [118] which sent the package with the error codes will be immediately stopped so that the problem associated with the error codes can be addressed and the elevator can resume safe operation. Similarly, if a package is expected to be received and it is not (e.g., if packages are expected to be sent every five milliseconds, if a package does not arrive within a certain arrival window centered around its expected time), then the elevator associated with the serialization module [118] whose package was not received will preferably be stopped so that the problem which caused the loss of communication can be identified and addressed, thereby allowing the elevator to resume safe operation.

Figure 4:
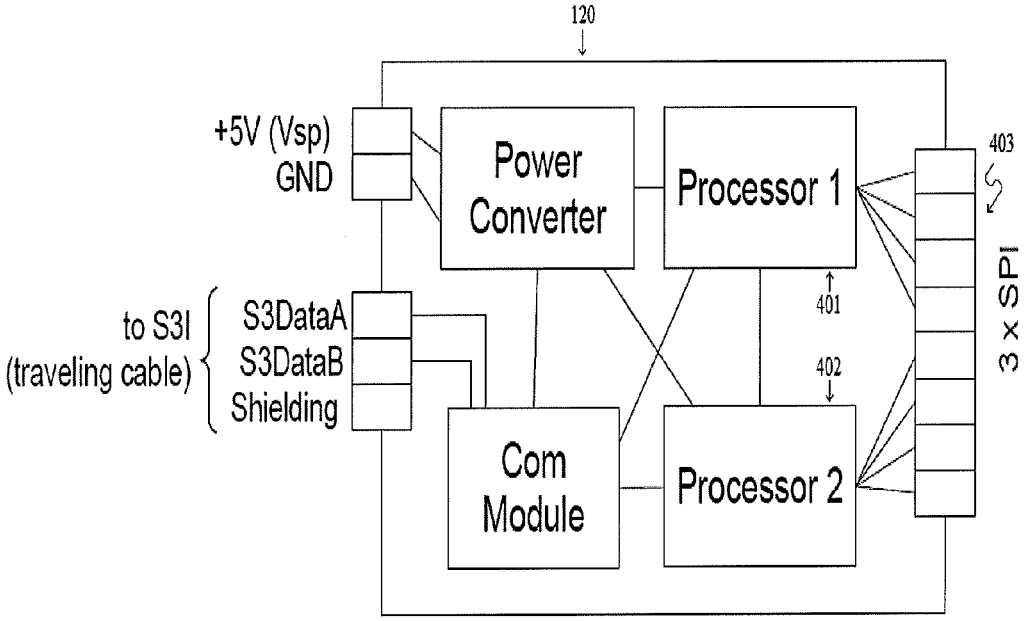
FIG. 4 illustrates an exemplary set of components which could be used to implement a deserialization module such as shown in FIG. 1.

Turning now to FIG. 4, that figure illustrates an exemplary set of components which could be used to implement a deserialization module [120] such as shown in FIG. 1. As with the discussion of FIG. 2, the discussion of FIG. 4 focuses on three main functions those components could perform—reading data packages received from the serialization module [118], building new data packages for transmission to the controller [121], and actually transmitting the new data packages to the controller [121]—to illustrate how those components could operate and interact with each other. As was the case with the discussion corresponding to FIG. 2, the following discussion of the components depicted in FIG. 4 should be understood as being illustrative only, and should not be treated as implying limitations on the protection accorded by this document or any related document.

Turning now to how the components depicted in FIG. 4 could be used to perform the functions described above, components such as shown in FIG. 4 will preferably be implemented in a manner which uses redundancy of components and data processing to increase reliability and safety. Accordingly, as was the case with the exemplary serialization module [118] depicted in FIG. 2, the exemplary deserialization module [120] depicted in FIG. 4 includes parallel microcontrollers [401][402]. These microcontrollers [401][402] can be configured to retrieve the data packages sent from the serialization module [118] and check those packages for consistency with each other, as well as for internal data corruption (e.g., using sequence numbers and cyclic redundancy check values, as described previously). The microcontrollers [401][402] can also be configured to, once the data packages have been retrieved and checked, use the information from those data packages to build new data packages which will be sent to the elevator controller [121].

As with a serialization module [118] such as discussed in the context of FIG. 2, a deserialization module [120] such as discussed in the context of FIG. 4 could be implemented in a variety of manners, including using a master/slave design similar to that discussed in the context of FIG. 2. For example, in a deserialization module [120] using such a master/slave design, a master microprocessor [401] would receive data packages from the serialization module [118] and build a new data package which could be transmitted to the elevator controller [121]. The slave microprocessor [402] would receive the same data package from the serialization module [118] and independently build a new data package. The slave microprocessor [402] would monitor for transmissions from the master microprocessor [401] and would compare the two independently created new data packages. If the slave microprocessor [402] detected any inconsistencies across the two independently created new data packages it would prevent the elevator controller [121] from receiving the new data package sent by the master microcontroller [401].

Figure 5:
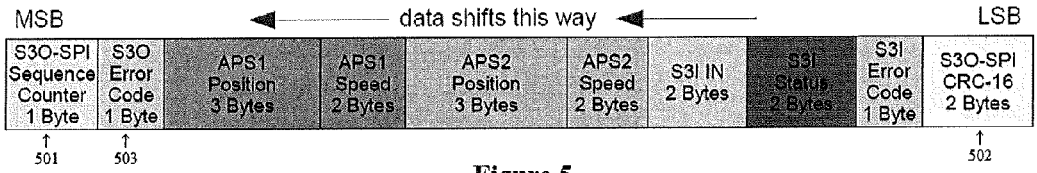
FIG. 5 illustrates an exemplary format which could be used for data packages communicated between a deserialization module and a controller.

An exemplary format which could be used for new data packages created by a deserialization module [120] is shown in FIG. 5. As shown in the labels in that figure, most of the data from the new data package is actually taken directly from the data packages received from the serialization module [118]. However, a new data package following the format of FIG. 5 will differ from the data package received from the serialization module [118] in that the first [501] and last [502] bytes of the new package include new sequence counter and cyclic redundancy check values determined by the deserialization module [120], rather than simply repeating the values from the original data package. Similarly, the second byte [503] of a new data package following the format of FIG. 5 will include new error codes, which error codes could indicate information such as whether there was a communication error in (or loss of) communication between the serialization and deserialization modules and whether there is an error in trying to communicate data from the deserialization module to the controller (or some other type of internal error in the deserialization module). As was the case with error handling as discussed in the context of FIG. 3, in the event that the error code information in a new data package indicates that an error has been detected, or an expected communication from the deserialization module is not received, the elevator or elevators whose information would be handled by that deserialization module would preferably be stopped so that the issue underlying the error or loss of communication could be resolved, and safe operation of the elevator or elevators could resume.

As with the data packages transmitted from the serialization module [118], these new data packages will preferably be independently created and cross checked against each other. Once they have been cross checked, the data packages will be communicated to the elevator controller [121] via a set (shown as a set of three interfaces in FIG. 4, though other numbers of interfaces could be used) of redundant serial to parallel (SPI) interfaces [403]. As with the switch input terminals [203] from FIG. 2, these redundant SPI interfaces [403] will preferably be cross checked against each other (e.g., by a separate comparison component [not shown], by one or more of the microcontrollers [401][402] from the deserialization module [120], and/or by the controller [121]) to identify if any of the interfaces [403] is corrupted.

The inclusion of particular examples, details, explanations and features in the above disclosure should not be treated as implying that this document or any document related to this document does not include within its scope variations on the above disclosure such as will be immediately apparent to, and could be implemented without undue experimentation by, one of ordinary skill in the art in light of the explicit disclosure set forth herein. For example, in the above disclosure, FIG. 2 illustrated the example serialization module [118] as having 16 switch input terminals [203], and FIGS. 3 and 5 illustrated exemplary data package formats as having two bytes (16 bits) of space reserved for storing information on the status of safety related switches. While this configuration represents a preferred approach to implementing the inventors' technology, it should be understood that other numbers of switch input terminals [203] (or even no switch input terminals, in the event that all safety information is collected from other types of sensors, such as absolute position sensors) could be used in systems implementing the disclosed technology, and that, in the event of changes in the numbers of switch input terminals, corresponding changes in the number of bits used to represent the status of the switches would also be made. Similar changes could be made in the numbers of other components (e.g., serialization and/or deserialization modules could be implemented to use more than redundant microcontrollers), in other aspects of data organization (e.g., data could be communicated using a different bit ordering than shown in FIGS. 3 and 5), or in other aspects of the operation of the system (e.g., data communication could take place with a different frequency than the 5 ms frequency identified in the above disclosure). Accordingly, the disclosure set forth herein should be understood as being illustrative only, and should not be treated as limiting.

In light of the above, the protection for the inventors' technology accorded by this document or any related document should not be limited to the material explicitly set forth herein. Instead, the protection accorded by this document, or any related document, should be understood as being defined by the claims in such document, when the terms in those claims which are listed under an "Explicit Definitions" heading are given the explicit definitions provided, and the remaining terms are given their broadest reasonable interpretation as shown by a general purpose dictionary. To the extent that the interpretation which would be given to the claims based on this document is in any way narrower than the interpretation which would be given based on the "Explicit Definitions" and the broadest reasonable interpretation as provided by a general purpose dictionary, the interpretation provided by the "Explicit Definitions" and broadest reasonable interpretation as provided by a general purpose dictionary shall control, and the inconsistent usage of terms in the specification of this or any related document shall have no effect.

Explicit Definitions

When used in the claim a statement that something is "based on" something else should be understood to mean that something is determined at least in part by the thing that it is indicated as being "based on." When something is completely determined by a thing, it will be described as being "based EXCLUSIVELY on" the thing.

When used in the claims, "cardinality" should be understood to refer to the number of elements in a set.

When used in the claims, "computer executable instructions" should be understood to refer to data which can be used to specify physical or logical operations which can be performed by a computer.

When used in the claims, "computer readable medium" should be understood to refer to any object, substance, or combination of objects or substances, capable of storing data or instructions in a form in which they can be retrieved and/or processed by a device. A computer readable medium should not be limited to any particular type or organization, and should be understood to include distributed and decentralized systems however they are physically or logically disposed, as well as storage objects of systems which are located in a defined and/or circumscribed physical and/or logical space. Computer memory such as hard discs, read only memory, random access memory, solid state memory elements, optical discs and registers is an example of a "computer readable medium."

When used in the claims, "configured" should be understood to mean that the thing "configured" is adapted, designed or modified for a specific purpose. An example of "configuring" in the context of computers is to provide a computer with specific data (which may include instructions) which can be used in performing the specific acts the computer is being "configured" to do. For example, installing Microsoft WORD on a computer "configures" that computer to function as a word processor, which it does by using the instructions for Microsoft WORD in combination with other inputs, such as an operating system, and various peripherals (e.g., a keyboard, monitor, etc).

When used in the claims, the term "data object" should be understood to refer to an identifiable and distinct entity expressed in a form (e.g., data stored in a computer readable medium) which can be manipulated by a computer.

When used in the claims, "database" should be understood be to a collection of data stored on a computer readable medium in a manner such that the data can be retrieved by a computer. The term "database" can also be used to refer to the computer readable medium itself (e.g., a physical object which stores the data).

When used in the claims, an "element" of a "set" (defined infra) should be understood to refer to one of the things in the "set."

When used in the claims, "means for reading, building a deserializer data package based on, and transmitting information comprising at least a portion of, the serializer data package" should be understood as being an element set forth in means+function form as permitted by 35 U.S.C. §102(f), where the corresponding structure described in the specification is a deserialization module [120] such as illustrated in FIGS. 1 and 4 and described in the corresponding text.

When used in the claims, "means for reading, building a serializer data package based on, and serially transmitting information comprising, safety related data for an elevator car" should be understood as being an element set forth in means+function form as permitted by 35 U.S.C. §112(f), where the corresponding structure described in the specification is a serialization module [118] such as illustrated in FIGS. 1 and 2 and described in the corresponding text.

When used in the claims, "remote" should be understood to refer to the relationship between entities which are physically distant from one another, such as between entities that communicate over a network.

When used in the claims, the term "set" should be understood to refer to a number, group, or combination of zero or more things of similar nature, design, or function.

When used in the claims, the term "storing" used in the context of a memory or computer readable medium should be understood to mean that the thing "stored" is reflected in one or more physical properties (e.g., magnetic moment, electric potential, optical reflectivity, etc) of the thing doing the "storing" for a period of time, however brief.

Accordingly, we claim:

1. A method for allowing safety data regarding an elevator installation to be communicated using a serial communication channel, the method comprising a set of transmission and receipt steps comprising:

a. at a serialization module:
   i. receiving a plurality of items of safety data for an elevator car;
   ii. building a serializer data package comprising the plurality of items of safety data for the elevator car; and
   iii. sending the serializer data package comprising the plurality of items of safety data for the elevator car to a deserialization module;

b. at the deserialization module:
   i. receiving the serializer data package comprising the plurality of items of safety data for the elevator car;
   ii. building a deserializer data package comprising the plurality of items of safety data for the elevator car; and
   iii. sending the deserializer data package comprising the plurality of items of safety data to a controller;

c. at the controller, determining, based on information from the deserialization module, whether the elevator car should be prevented from operating as a result of a safety problem.

2. The method of claim 1, wherein;

a. the serialization module and deserialization module each comprise a plurality of microcontrollers;

b. receiving the plurality of items of safety data for the elevator car at the serialization module comprises receiving the plurality of items of safety data for the elevator car independently at two or more microcontrollers from the serialization module's plurality of microcontrollers;

c. building the serializer data package comprising the plurality of items of safety related data for the elevator car comprises building the serializer data package independently at two or more microcontrollers from the serialization module's plurality of microcontrollers;

d. receiving the serializer data package comprising the plurality of items of safety data for the elevator car comprises receiving the serializer data package independently at two or more microcontrollers from the deserialization module's plurality of microcontrollers; and e. building the deserializer data package comprising the plurality of items of safety data for the elevator car comprises building the deserializer data package independently at two or more microcontrollers from the deserialization module's plurality of microcontrollers;

f. the set of transmission and receipt steps further comprises:
   i. checking the plurality of items of safety data received at the serialization module by performing acts comprising comparing data from the plurality of items of safety data as received at one of the serialization module's plurality of microcontrollers against data from the plurality of items of safety data received at another of the serialization module's plurality of microcontrollers;
   ii. checking the independently built serializer data packages by performing acts comprising comparing the serializer data package as built by one of the serialization module's plurality of microcontrollers with the serializer data package as built by another of the serialization module's plurality of microcontrollers; and
   iii. checking the independently built deserializer data packages by performing acts comprising comparing the deserializer data package as built by one of the deserialization module's plurality of microcontrollers with the deserializer data package as built by another of the deserialization module's plurality of microcontrollers.

3. The method of claim 2, wherein:

a. sending the deserializer data package to the controller comprises communicating the deserializer data package to the controller independently through a plurality of serial peripheral interfaces comprised by the deserialization module;

b. sending the serializer data package to the deserialization module comprises sending the serializer data package in serial form over a cable using a non-return to zero code; and c. the set of transmission and receipt steps comprises determining whether any of the deserialization module's serial peripheral interfaces is corrupted by checking the deserialization module's serial peripheral interfaces against each other.

4. The method of claim 1, wherein:

a. the serializer data package comprises the safety data for the elevator car surrounded by supplemental data added by the serialization module, wherein the supplemental data added by the serialization module comprises:
   i. a sequence counter for the serializer data package;
   ii. a corruption check value for the serializer data package;
   iii. status information; and
   iv. error information;

b. the deserializer data package comprises:
   i. the safety data for the elevator car;
   ii. the status information from the serializer data package;
   iii. the error information from the serializer data package;
   iv. additional error information;
   v. a sequence counter for the deserializer data package; and
   vi. a corruption check value for the deserializer data package.

5. The method of claim 4 wherein:

a. the safety data for the elevator car comprises:
   i. on/off status information for a plurality of switches;
   ii. speed of the elevator car; and
   iii. position for the elevator car;

b. the corruption check value is either:
   i. a cyclic redundancy check value calculated for the data package; or
   ii. a checksum value calculated for the data package;

c. the status information comprises:
   i. alignment data for speed and position sensors for the elevator car; and
   ii. whether the elevator car is recommended for service or is in a warning state;

d. the error information comprises one or more codes indicating error types comprising:
   i. internal errors in the serialization module;
   ii. faults in one or more switches from the plurality of switches; and
   iii. errors in sensors used to detect speed and position of the elevator car;

e. the additional error information comprises one or more codes indicating error types comprising:
   i. errors in communication between the serialization module and the deserialization module; and
   ii. internal errors in the deserialization module.

6. The method of claim 4, wherein determining, based on information from the deserialization module, whether the elevator car should be prevented from operating as a result of a safety problem comprises performing one or more acts from the set consisting of:

a. determining whether an error is indicated by the error information from the serializer data package or the additional error information;

b. determining whether an error is indicated by the additional error information;

c. determining, based on the sequence counter for the deserializer data package, whether a data package has been lost, inserted, repeated, or is out of sequence;

d. determining, based on elapsed time since data package receipt, whether a data package has been lost; and e. determining, whether data communicated from the deserialization module to the controller has been corrupted.

7. The method of claim 1, wherein the method comprises repeatedly performing the set of transmission and receipt steps at 5 ms intervals.

8. A system for allowing safety data regarding an elevator installation to be communicated using a serial communication channel, the system comprising:

a. a serialization module configured to perform a set of serialization steps comprising:
   i. receiving a plurality of items of safety data for an elevator car;
   ii. building a serializer data package comprising the plurality of items of safety data for the elevator car; and
   iii. sending the serializer data package comprising the plurality of items of safety data for the elevator car to a deserialization module;

b. the deserialization module, the deserialization module configured to perform a set of deserialization steps comprising:
   i. receiving the serializer data package comprising the plurality of items of safety data for the elevator car;
   ii. building a deserializer data package comprising the plurality of items of safety data for the elevator car; and
   iii. sending the deserializer data package comprising the plurality of items of safety data to a controller;

c. a controller configured to determine, based on information from the deserialization module, whether the elevator car should be prevented from operating as a result of a safety problem.

9. The system of claim 8, wherein;

a. the serialization module comprises a plurality of microcontrollers and is configured to, in performing the set of serialization steps:
   i. receive the plurality of items of safety data for the elevator car independently at two or more microcontrollers from the serialization module's plurality of microcontrollers;
   ii. check the received plurality of items of safety related data by performing acts comprising comparing data from the plurality of items of safety related data as received at one of the microcontrollers from the serialization module's plurality of microcontrollers against data from the plurality of items of safety related data received at a different microcontroller from the serialization module's plurality of microcontrollers; and
   iii. build the serializer data package independently at multiple microcontrollers from the serialization module's plurality of microcontrollers; and b. the deserialization module comprises a plurality of microcontrollers and is configured to, in performing the set of deserialization steps:
   i. receive the serializer data package independently at two or more microcontrollers from the deserialization module's plurality of microcontrollers;
   ii. build the deserializer data package comprising the plurality of items of safety data for the elevator car independently at multiple microcontrollers from the deserialization module's plurality of microcontrollers;

c. the system is configured to perform acts comprising:

i. checking the plurality of items of safety data received at the serialization module by performing acts comprising comparing data from the plurality of items of safety data as received at one of the serialization module's plurality of microcontrollers against data from the plurality of items of safety data received at another of the serialization module's plurality of microcontrollers;

ii. checking the independently built serializer data packages by performing acts comprising comparing the serializer data package as built by one of the serialization module's plurality of microcontrollers with the serializer data package as built by another of the serialization module's plurality of microcontrollers; and iii. checking the independently built deserializer data packages by performing acts comprising comparing the deserializer data package as built by one of the deserialization module's plurality of microcontrollers with the deserializer data package as built by another of the deserialization module's plurality of microcontrollers.

10. The system of claim 9, wherein:

a. the deserialization module comprises a plurality of serial peripheral interfaces, and sending the deserializer data package to the controller comprises communicating the deserializer data package to the controller independently through the deserialization module's plurality of serial peripheral interfaces;

b. sending the serializer data package to the deserialization module comprises sending the serializer data package in serial form over a cable using a non-return to zero code; and c. the system is further configured to determine whether any of the deserialization module's serial peripheral interfaces is corrupted by checking the deserialization module's serial peripheral interfaces against each other.

11. The system of claim 8, wherein:

a. the serializer data package comprises the safety data for the elevator car surrounded by supplemental data added by the serialization module, wherein the supplemental data added by the serialization module comprises:

i. a sequence counter for the serializer data package;

ii. a corruption check value for the serializer data package;

iii. status information; and iv. error information;

b. the deserializer data package comprises:

i. the safety data for the elevator car;

ii. the status information from the serializer data package;

iii. the error information from the serializer data package;

iv. additional error information;

v. a sequence counter for the deserializer data package; and vi. a corruption check value for the deserializer data package.

12. The system of claim 11 wherein:

a. the safety data for the elevator car comprises:

i. on/off status information for a plurality of switches;

ii. speed of the elevator car; and iii. position for the elevator car;

b. the corruption check value is either:

i. a cyclic redundancy check value calculated for the data package; or ii. a checksum value calculated for the data package;

c. the status information comprises:

i. alignment data for speed and position sensors for the elevator car; and ii. whether the elevator car is recommended for service or is in a warning state;

d. the error information comprises one or more codes indicating error types comprising:

i. internal errors in the serialization module;

ii. faults in one or more switches from the plurality of switches; and iii. errors in sensors used to detect speed and position of the elevator car;

e. the additional error information comprises one or more codes indicating error types comprising:

i. errors in communication between the serialization module and the deserialization module; and ii. internal errors in the deserialization module.

13. The system of claim 11, wherein determining, based on information from the deserialization module, whether the elevator car should be prevented from operating as a result of a safety problem comprises performing one or more acts from the set consisting of:

a. determining whether an error is indicated by the error information from the serializer data package or the additional error information;

b. determining whether an error is indicated by the additional error information;

c. determining, based on the sequence counter for the deserializer data package, whether a data package has been lost, inserted, repeated, or is out of sequence;

d. determining, based on elapsed time since data package receipt, whether a data package has been lost; and e. determining, whether data communicated from the deserialization module to the controller has been corrupted.

14. The system of claim 8, wherein the system is configured to:

a. perform the set of serialization steps;

b. perform the set of deserialization steps;

c. determine, based on information from the deserialization module, whether the elevator car should be prevented from operating as a result of a safety problem;

repeatedly at 5 ms intervals.

15. A machine comprising:

a. means for reading, building a serializer data package based on, and serially transmitting information comprising, safety related data for an elevator car;

b. means for reading, building a deserializer data package based on, and transmitting information comprising at least a portion of, the serializer data package; and c. a controller, wherein the controller is:

i. communicatively connected to the means for reading, building the deserializer data package based on, and transmitting information comprising at least a portion of, the serializer data package; and ii. configured to determine whether the elevator car should be prevented from operating as a result of a safety problem.

16. The machine of claim 15, wherein:

a. the machine further comprises a cable connecting:

i. the means for reading, building the serializer data package based on, and serially transmitting information comprising, safety related data for the elevator car; with ii. the means for reading, building the deserializer data package based on, and transmitting information comprising at least the portion of, the serializer data package;

and b. transmitting information comprising safety related data for the elevator car comprises transmitting the serializer data package over the cable using a non-return to zero code.

* * * * *